United States Patent [19]

Edwards

[11] Patent Number: 4,642,957

[45] Date of Patent: Feb. 17, 1987

[54] INTERIOR WALL TRIM SYSTEM

[76] Inventor: Troy C. Edwards, 2801 Church Dr., Denton, Tex. 76205

[21] Appl. No.: 839,868

[22] Filed: Mar. 13, 1986

Related U.S. Application Data

[63] Continuation-in-part of Ser. No. 680,302, Dec. 11, 1984, abandoned, which is a continuation-in-part of Ser. No. 526,435, Aug. 25, 1983, abandoned.

[51] Int. Cl.[4] ..... E04F 19/04

[52] U.S. Cl. ..... 52/242; 52/287; 52/288; 52/280; 52/717.1; 403/231; 403/295

[58] Field of Search ..... 52/280, 282, 287, 288, 52/242, 465, 466, 278, 716, 717.1, 718.1; 403/231, 295, 402, 403

[56] References Cited

U.S. PATENT DOCUMENTS

| | | | |
|---|---|---|---|
| 1,229,765 | 6/1917 | Lehman | 52/287 |
| 1,250,594 | 12/1917 | Knapp | 52/287 |
| 1,789,102 | 1/1931 | Jorgensen | 52/280 |
| 1,975,769 | 10/1934 | Cederholm et al. | 52/466 |
| 2,097,988 | 11/1937 | Ross et al. | 52/287 |
| 2,121,213 | 6/1938 | Small | 52/280 |
| 2,274,317 | 2/1942 | Bonnell | 52/287 |
| 2,303,103 | 11/1942 | Adams | 52/715 |
| 2,325,766 | 8/1943 | Gisondi | 52/361 |
| 3,422,584 | 1/1969 | Howard | 52/718 |
| 3,534,516 | 10/1970 | Cooper | 52/242 |
| 3,676,966 | 7/1972 | Ragland | 52/211 |
| 3,707,061 | 12/1972 | Collette et al. | 52/288 |
| 3,717,968 | 2/1973 | Olsen et al. | 52/288 |
| 3,812,621 | 5/1974 | Ragland | 49/505 |
| 3,886,688 | 6/1975 | Ragland | 49/504 |
| 4,006,573 | 2/1977 | Biebuyck | 52/732 |
| 4,068,432 | 1/1978 | Davis | 52/241 |
| 4,104,839 | 8/1978 | Balzer et al. | 52/288 |
| 4,192,113 | 3/1980 | Martin | 52/282 |
| 4,205,486 | 6/1980 | Guarnacci | 403/403 |
| 4,361,994 | 12/1982 | Carver | 52/241 |
| 4,430,833 | 2/1984 | Balzer et al. | 52/287 |
| 4,452,022 | 1/1984 | Bezborodko | 52/416 |
| 4,569,171 | 2/1986 | Kuhr et al. | 52/288 |

FOREIGN PATENT DOCUMENTS

| | | | |
|---|---|---|---|
| 45935 | 7/1932 | Denmark | 52/288 |
| 323832 | 1/1930 | United Kingdom | 52/718 |
| 1186222 | 4/1970 | United Kingdom | 52/288 |

*Primary Examiner*—James L. Ridgill, Jr.

*Attorney, Agent, or Firm*—Hubbard, Thurman, Turner & Tucker

[57] ABSTRACT

An interior wall partition trim assembly for providing a decorative trim at the junction of interior wall partitions with each other or with the ceiling or floor structure, comprising molded vinyl channel shaped cap members for placement along the intersection of a wall with a ceiling, at an inside corner, and an outside corner and the intersection of the walls with the floor surface. Integral molded junction members at the corners between inside and outside wall intersections with the floor and ceiling eliminate the requirement for cutting mitered joints between the trim members. Cap members are releasably secured in position by spaced apart retainer plates which are formed plastic members having a planar web portion and opposed standoff flanges which engage resiliently deflectable flanges of the cap members. The cap member flanges are formed with opposed reentrant edges to forcibly engage the standoff flanges of the retainer members to secure the cap members in assembly with the retainer members for securement to the mating portions of the respective cap members.

13 Claims, 12 Drawing Figures

INTERIOR WALL TRIM SYSTEM

CROSS REFERENCE TO RELATED APPLICATION

This application is a continuation-in-part of U.S. patent application Ser. No. 680,302, filed Dec. 11, 1984 now abandoned which in turn is a continuation-in-part of U.S. patent application Ser. No. 526,435, filed Aug. 25, 1983, now abandoned.

BACKGROUND OF THE INVENTION

1. Field of the Invention

The present invention pertains to an interior wall molding or trim system assembly having horizontal and vertical continuous plastic trim members supported by retainer plates which are attached to wall panels adjacent the marginal edges of a wall or similar partition.

2. Background

In the art of building interior wall partition construction and finishing system assemblies it is important that the marginal edge trim members for the junctions between contiguous vertical walls and the junctions between vertical walls and ceilings and floors be aesthetically appealing but also be relatively easy to install. The trim members must also be capable of covering misalignment between adjacent wall panels and possible gaps at the joints between adjacent walls and between the walls and ceiling or floor surfaces.

One improvement in an interior wall partition support and trim system is disclosed and claimed in the earliest above identified patent application. Although the wall partition header or support track described in the above identified application is particularly advantageous for some types of installations it has been realized that wherein the interior wall partitions may be somewhat more temporary or erected with relatively unskilled labor or persons not familiar with the system components that it is important that the aesthetic appeal of the interior walls be equal to other systems and that the speed with which the trim system can be installed be enhanced to increase productivity and reduce the installation cost. It is to this end that the present invention has been developed with a view to providing an interior wall or partition trim system which utilizes several unique components to provide a trim system which is easy to install and attractive in appearance.

SUMMARY OF THE INVENTION

The present invention pertains to an improved interior wall molding or trim system assembly comprising a generally elongated somewhat channel shaped trim cap member which is secured at spaced apart intervals by retainer members to place the cap member adjacent a marginal edge of a wall panel at the juncture of the panel with a ceiling or floor surface, a wall panel contiguous with another wall panel or around window and door openings and frames.

In accordance with one aspect of the present invention there is provided an interior wall trim system comprising elongated continuous channel shaped trim cap members which are adapted to be forced or snap fitted into and off of retainer means comprising elongated or spaced apart members having a web portion securable to a wall surface and a pair of opposed standoff flanges for receiving the opposed flanges of the cap members. One embodiment of the cap member is adapted to serve as a baseboard trim member and includes a resiliently deflectable upper edge or flange portion which bears against the vertical wall surface and a lower downwardly depending flange portion which is adapted to be contiguous with a floor surface or covering. Inside and outside corner cap members are also provided for covering joints between intersecting vertical walls.

In accordance with another aspect of the present invention the trim system includes premolded plastic inside and outside corner base members adapted to be connectd to linear runs of the baseboard members by retainer portions having the same cross sectional configuration as the individual retainer members.

In accordance with still another aspect of the present invention the interior wall trim system includes inside and outside corner trim members which are premolded of durable plastic such as vinyl to eliminate the need for preparation of mitered joints between adjacent cap members at wall intersections. The molded corner members have retainer portions extending in two or three mutually perpendicular directions for engagement with the linear cap member portions and with inside and outside corner cap members, respectively.

The trim system of the present invention is particularly easy to install and is operable to cover and conceal joints between adjacent walls and joints between walls and ceiling and floor surfaces without requiring the cutting of mitered joints. The retainer portions of the molded corner members and the retainer members for the continuous cap members are advantageously provided with fastener receiving slots so that the retainers may be adjusted during assembly of the various moldings or trim members to assure proper alignment and closing of joints between respective wall, ceiling and floor members. If separation of the trim member from an adjacent partition panel member occurs after assembly due to building shift or settling, the trim members may be adjusted to close any joint or gap which might develop. Moreover, the trim system of the present invention may be utilized with various types of wall panel support structures including conventional wall panel headers or spacers. The various components of the trim system are preferably formed of extruded or injection molded vinyl plastic or polyethylene.

Those skilled in the art will recognize the above described features and advantages of the present invention as well as additional superior aspects thereof upon reading the detailed description which follows in conjunction with the drawing.

DESCRIPTION OF THE PREFERRED EMBODIMENTS

Figure 1:
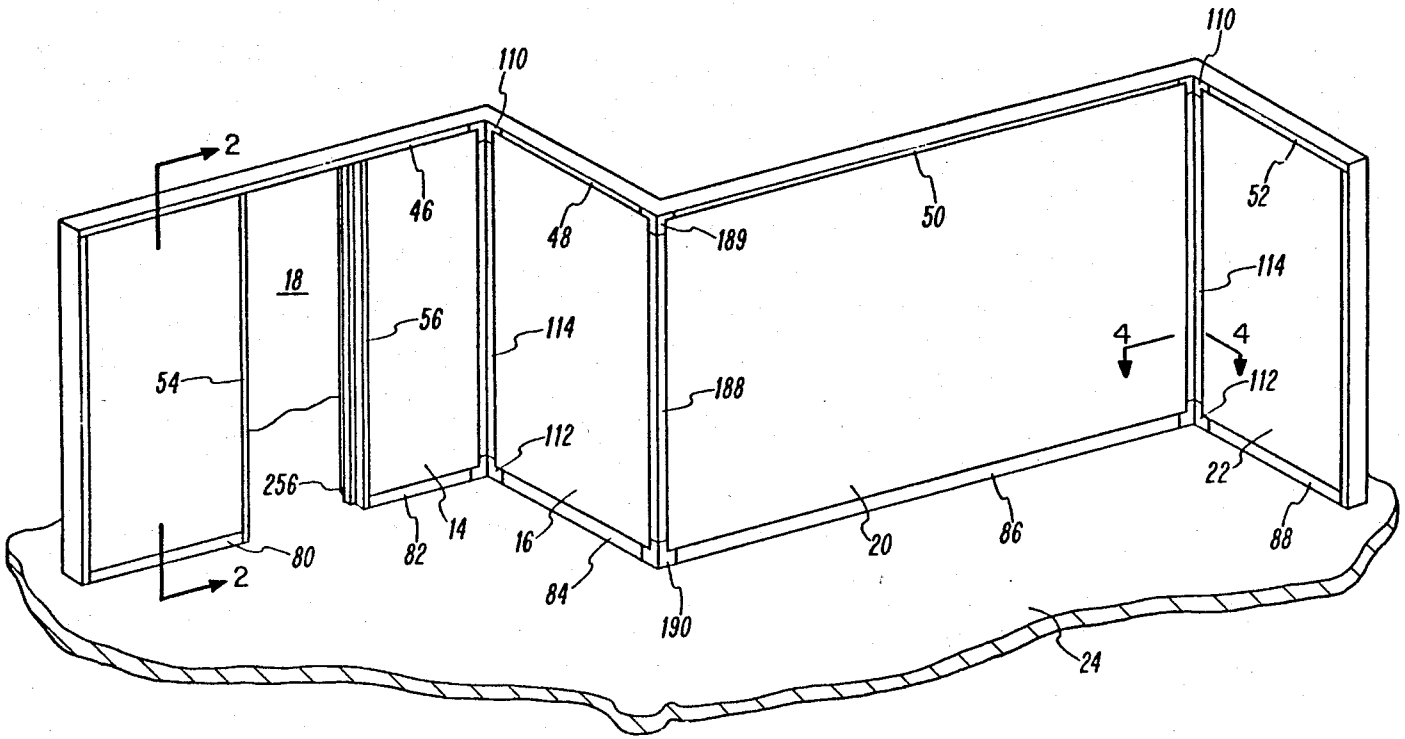
FIG. 1 is perspective view of a portion of an interior wall partition including the wall trim system of the present invention.

In the description which follows like parts are marked throughout the specification and drawing with the same reference numerals, respectively. The drawing figures are not necessarily to scale and certain features of the invention may be shown exaggerated in scale in the interest of clarity.

Figure 2:
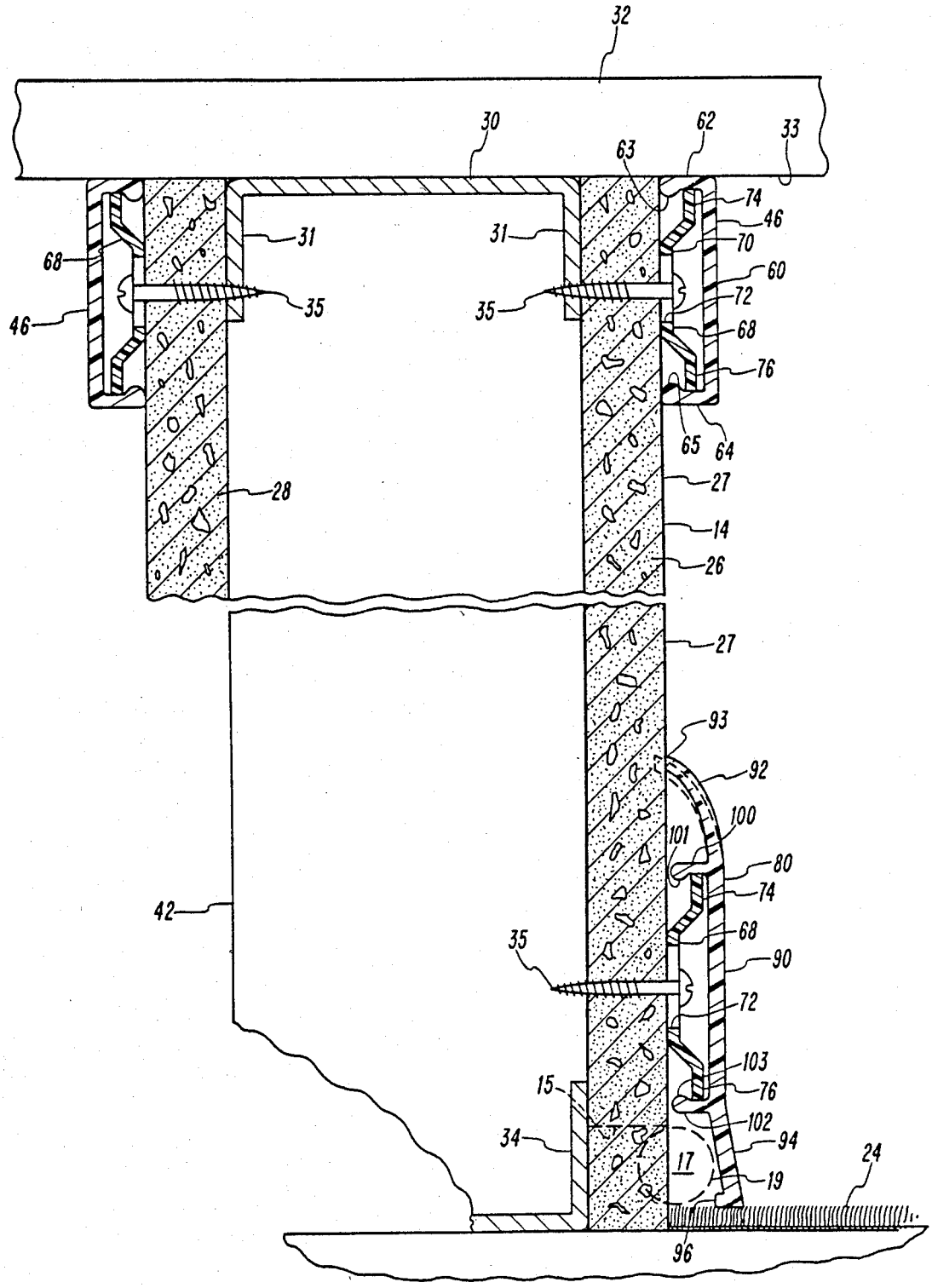
FIG. 2 is a section view taken along the line 2—2 of FIG. 1.

Referring to FIG. 1 the interior wall trim system of the present invention is illustrated in use and in conjunction with an interior wall partition arrangement comprising intersecting vertical walls 14 and 16 and wherein the vertical wall 14 includes a doorway 18. The partition arrangement also includes a vertical wall 20 contiguous with and intersecting the vertical wall 16 and a vertical wall 22 contiguous with and intersecting the vertical wall 20. A section of flooring 24 is illustrated in FIG. 1 and the ceiling is removed to show the location of various components of the trim system. Referring also to FIG. 2, by way of example, the interior walls 14, 16, 20 and 22 are typically made up of spaced apart panels of gypsum wallboard such as the panels 26 and 28 shown for the wall 14. The panels 26 and 28 are typically secured to an elongated channel shaped header or support plate 30 secured to a ceiling support member 32 and a floor header or plate 34 secured to the floor 24. The headers 30 and 34 are typically relatively light gauge steel or aluminum channel members having opposed flanges 31 for the header 30, for example. The headers 30 and 34 may be identical in construction and secured to the ceiling grid member 32 and the floor 24 by conventional fastener means, not shown. The wallboard panels 26 and 28 are typically secured to the flanges of the respective header members 30 and 34 by conventional fasteners 35. Similarly, spaced apart column members such as the column 42, FIG. 2, may be secured between the headers 30 and 34 and provide additional support for the wallboard panels 26 and 28. The walls 16, 20 and 22 are similarly constructed and are not believed to require detailed explanation in order to enable one skilled in the art to practice the present invention.

The arrangement of ceiling and floor header members 30 and 34 together with spaced apart column members 42 disposed at suitable spacings provide easily constructed and adequate support for the wallboard panels 26 and 28 as well as the wallboard panels making up the walls 16, 20 and 22. However, the ease of assembly or construction of the walls 14, 16, 20 and 22, together with the likelihood that exact fits cannot be made between the top, bottom and side edges of the walls with adjacent ceiling, floor or wall surfaces makes it highly desirable that some form of finishing or trim arrangement be provided to conceal the joints between the wall panels with the ceiling and the floor as well as the junctions between adjacent intersecting wall panels. Moreover, it is also highly desirable that an aesthetically pleasing trim member be provided which is easy to install but which conceals the gaps or irregularities between the adjacent wall, ceiling, floor and other surfaces formed by the construction of interior wall partitions including doorways, window frames and other openings in the walls.

Referring further to FIGS. 1 and 2 one component of the trim system of the present invention comprises an elongated trim cap member 46 which may be of predetermined length as determined by the length of the wall 14, 16, 20 or 22. For the sake of discussion herein the trim cap members 46, 48, 50, 52, 54 and 56 are designated because each is of a different length or in a different location. However, the cross sectional configuration of each of the cap members 46, 48, 50, 52, 54 and 56 is identical and according to that shown in FIG. 2. Referring to FIG. 2, the cap member 46 includes a generally planar web portion 60 and opposed flange portions 62 and 64. The flange portions 62 and 64 are formed integral with the web portion 60 and are provided with opposed inward facing reentrant edges 63 and 65 having generally the same configuration as that described in the above referenced U.S. patent application, Ser. No. 680,302.

The flange portions 62 and 64 are of sufficient thickness such that they may be deflected relative to each other and to the web portion 60 so that the reentrant edges 63 and 65 may be snapped over and secured to one or more cap member retainer plates, generally designated by the numeral 68. The retainer plate 68 includes a generally planar web portion 70 having an elongated transversely extending slot 72, formed therein and opposed standoff flanges 74 and 76. The flanges 74 and 76 stand off from the plane of the web portion 70 sufficiently to permit the reentrant edges 63 and 65 of the cap member 46 to be trapped between the surface 27 of the wall panel 26 and the edges of the standoff flanges 74 and 76. They should be slightly biased against the surface 27 of the wall panel.

It is contemplated in accordance with the present invention that the retainer members may be on the order of approximately 2.0 inches in length and spaced apart 18.0 inches to 24.0 inches along the joint to be trimmed such as the joint between the ceiling member 32 and the wall panel 26. The retainer members 68 are preferably formed of relatively rigid polyethelene plastic and are secured in predetermined positions by the helical threaded nail type fasteners 35 which are of the type typically used for securing elements to gypsum wallboard type wall panels or the like. Thanks to the provision of the slots 70 the position of each of the retainers 68 may be adjusted relative to the surface of the ceiling member 32, for example, so that the cap member 46 is positioned with one of its opposed flanges virtually in contact with the surface 33 of the ceiling member 32. This may be done after the cap member 46 is installed by urging the cap member in one direction or another with sufficient force to overcome the holding force of the fasteners 35. The cap members 46, 48, 50, 52, 54 and 56 are, of course, each applied to the respective wall panels by retainer members 68. If joints should separate due to building shift or settling, the trim members may be readjusted to close any gaps or spaces between adjacent panels. The cap members should be installed after wall painting or plastering operations are completed. Then any paint or plaster splattered on retainer members 68 during construction is covered up by cap members such as cap member 46. In addition since the retainer members are preferably made of polyethylene, excess paint or plaster is easily wiped off because they do not adhere well to that material.

Referring further to FIGS. 1 and 2, the trim system of the present invention includes an elongated continuous baseboard trim member which may be cut to predetermined lengths and designated by the numerals 80, 82, 84, 86 and 88 in FIG. 1. Each of the baseboard trim members 80, 82, 84, 86 and 88 is formed from predetermined stock lengths of baseboard trim member cut to predetermined lengths and are of the cross sectional configuration illustrated in FIG. 2.

As shown in FIG. 2, by way of example, the trim member 80 includes a generally planar web portion 90, an upper, generally arcuate flange portion 92 terminating at a distal end 93 and a lower, generally planar flange portion 94 extending at an angle relative to the plane of the web portion 90 and in a direction opposite to the curvature of the flange portion 92. The distal edge of the flange 94 may include a short tab portion 96 extending at an acute angle with respect to the flange 94 and generally perpendicular to the plane of the web portion 90. The general shape of the trim members 80, 82, 84, 86 and 88 is aesthetically pleasing and is functional as regards the minimization of collection of dust, and the facilitation of cleaning floor surfaces such as the floor 24 adjacent its junction with the panel 26, for example, In fact, the flange 94 may be deflected sufficiently to assure that cleaning operations using mechanical vacuum cleaners or manual cleaning utensils may easily clean the intersection of the flange 94 with the surface of floor 24 or any covering thereon.

The baseboard trim members such as the trim member 80 each include spaced apart projections 100 and 102 which project from the web portion 90 in the same direction of the flange 92 and away from the angular extent of the flange 94. The projections 100 and 102 include opposed reentrant edges 101 and 103 which are spaced apart such that deflection of the web 90 to spread the projections 100 and 102 away from each other will permit snapping the baseboard trim member 80 into the position shown in FIG. 2 to be retained against the wall surface 27 by a retainer member 68. Thanks to the provision of the standoff flanges 74 and 76 the reentrant edges 101 and 103 of the projections 100 and 102 are also utilized to retain the baseboard trim members in the positions illustrated in FIGS. 1 and 2. Moreover, the distal end 93 of the flange 92 is determined to be, in a relaxed position, located relative to the projections 100 and 102 such that upon assembly of the baseboard trim member 80 to the retainer member 68 the flange 92 will be deflected slightly from its relaxed position, indicated by the dotted lines in FIG. 2, to the position shown by the solid lines in FIG. 2. In this way a relatively snug fit of the upper flanges of the baseboard trim members may be obtained against a vertical wall surface.

Another advantage of the baseboard member 80 resides in the fact that the wall panel 14 may be cut off at the line 15 in FIG. 2 above the floor surface 24 whereby the space formed between the floor surface, the lower edge 15 of the wall panel and the depending flange 94 may form a chase 17 for receiving electrical conduits 19 and the like. In many applications the wall panels are terminated at a point above the floor surface to prevent absorption of puddled rain water during construction of the building. Certainly, the provision of the baseboard trim member 80 advantageously closes the joint gap formed by the shortened edge 15 of the wall panel.

The trim cap members, including the cap member 46, and the baseboard trim member 80 are preferably formed of an extrusion grade of vinyl plastic meeting ASTM specification D-1784-65T type 2, grade 1, which is available from B. F. Goodrich Chemical Company, Cleveland, Ohio under the trademark GEON. The plastic material may, of course, be provided in preselected colors and the complete through coloring of the thickness of the material used in making the components of the trim system described herein reduces the chance of disfigurement of the components in the event of chipping, nicking or other disfigurement which will be virtually undetectable due to the solid coloring of the material. Unlike traditional headers which have a visible portion which descends on either side of an inside wall and are a single color, the trim cap member of the invention can be made of different colors to provide a choice of trim colors without painting for walls on either side of a partition.

Figure 3:
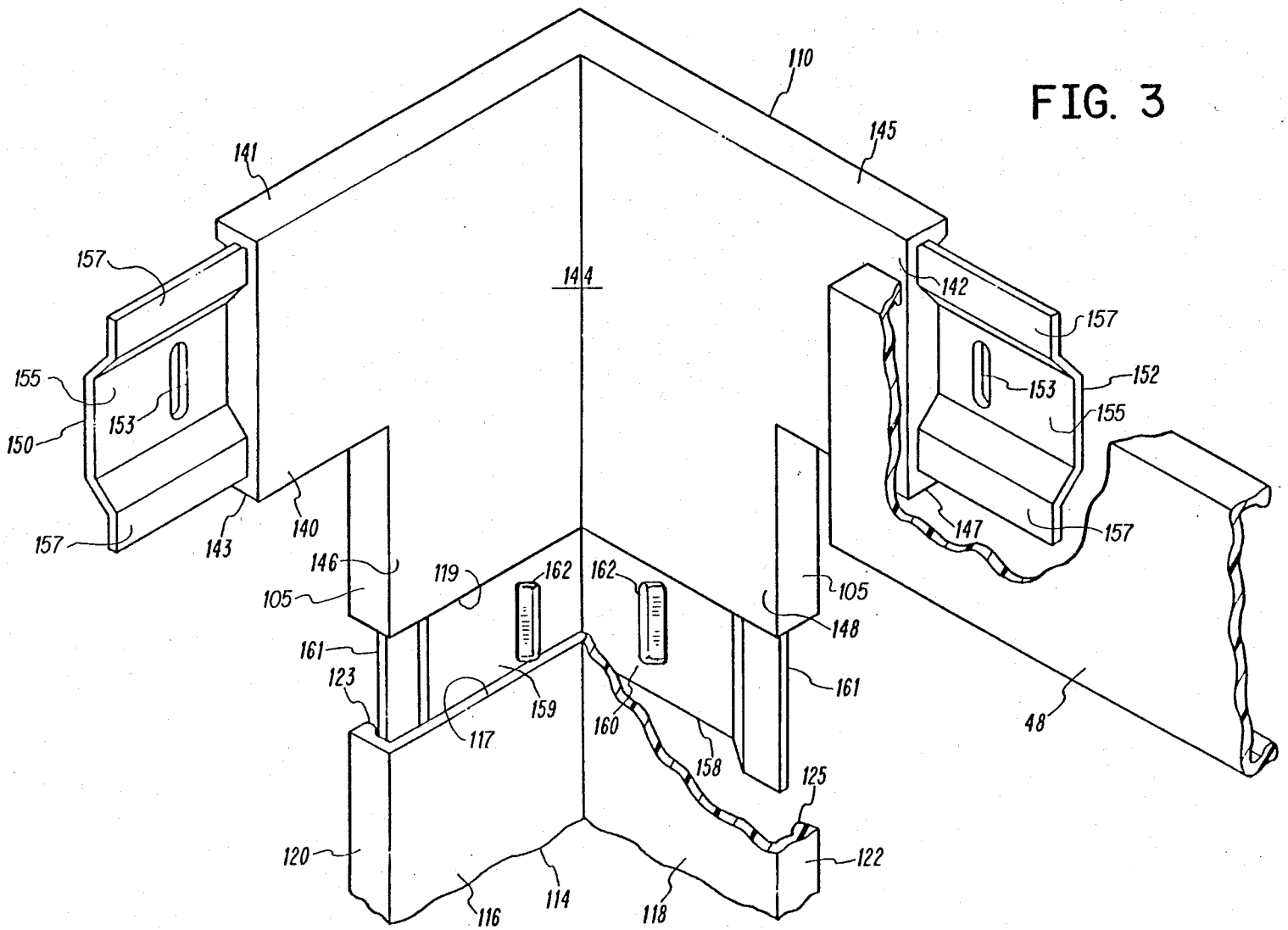
FIG. 3 is a detail perspective view of an inside corner junction member for the junction of two ceiling-wall trim cap members and an inside corner trim cap member.
Figure 4:
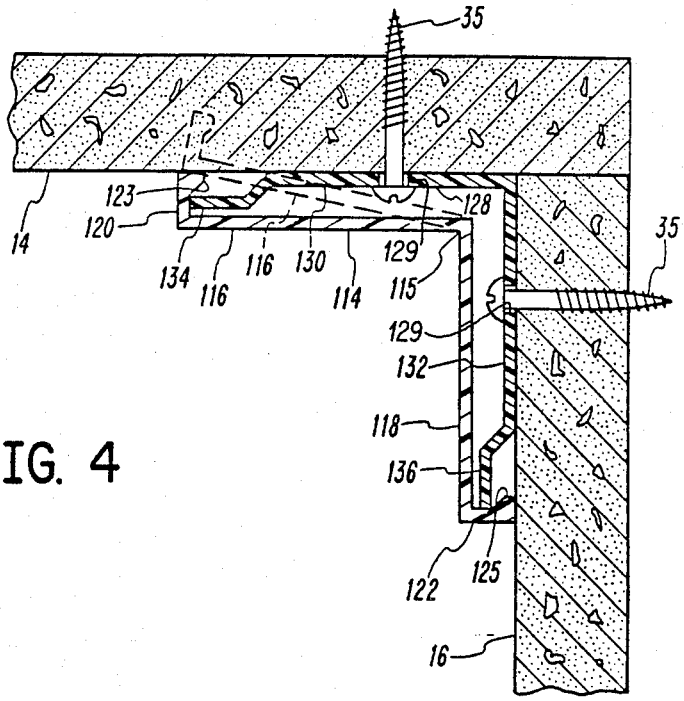
FIG. 4 is a detail section view taken along the line 4—4 of FIG. 1.

Referring now briefly to FIG. 1 and also FIGS. 3 and 4, one particular advantage of the trim system of the present invention is the provision of respective inside and outside corner trim components comprising junction members which eliminate the requirement of cutting mitered joints for the cap members 46, 48, 50 and 52 and the baseboard members 82, 84, 86 and so on. As shown in FIG. 1, inside corner junction members 110 and 112 are provided for the respective ceiling to wall and floor to wall trim members and also form junctions between these trim members and an inside corner cap member 114. Referring to FIGS. 3 and 4, the cap member 114 includes a continuous extruded vinyl plastic member having opposed integrally joined web portions 116 and 118 extending at substantially right angles to each other in the mounted position. The cap member 114 includes opposed flanges 120 and 122 having reentrant inner edge portions 123 and 125 which are adapted to retain the cap member by a retainer plate 128 having opposed web portions 130 and 132 with respective standoff flanges 134 and 136 adapted to engage the respective edges 123 and 125 of the cap member 114. The flanges of the corner cap member if bent at a slight angle so as to grip the standoff flanges of the retainer plate can be held by friction even if the reentrant inner edge portions are omitted. The retainer member or members 128 may be of predetermined lengths similar to the retainer members 68 and are suitably secured to the adjacent wall panels 14 and 16 by fasteners 35. The retainer members 128 may be provided with suitable holes or vertically extending elongated slots 129 formed in the web portions 130 and 132 for receiving the fasteners 35. As described in the above referenced patent application the cap member 114 is preferably formed with an elastic memory at an integral hinge portion 115 between the webs 116 and 118, which normally biases the web 116 into the dotted line position indicated in FIG. 4 relative to the web 114. The vertically extending slots 129 allow the retainer plate 128 to be shifted up or down as required without moving the fasteners 35.

Referring now to FIG. 3, the junction member 110 includes opposed integral cap portions 140 and 142 and an integrally formed right angle depending cap portion 144 having opposed right angle webs 146 and 148. The opposed laterally extending cap portions 140 and 142 each include respective parallel flanges 141, 143, 145 and 147 which have a cross sectional configuration similar to the opposed flanges of the cap member 46. However, the junction member 110 also includes opposed retainer portions 150 and 152 having stand-off flanges with the same cross sectional configuration as the retainer members or plates 68. Each of retainer portions 150, 152 has a web portion 155 and flange portions 157. The web portion 155 of each retainer portion and the flanges 141, 143, 145 and 147 rest evenly in contact with the respective walls of the inside corner when fasteners are fixed to the walls through the slotted holes 153. The retainer parts 150 and 152 are integrally molded as part of the member 110. The retainer parts 150 and 152 also include elongated slots 153 to provide for securing the junction members to the adjacent wall panels such, as the panels 14 and 16, with suitable fasteners of the type described above and to provide for vertical adjustment along the corner joint formed by said wall panels.

The depending cap portion 144 is of the same configuration and cross section as the cap member 114 and includes a retainer part 158 having a cross sectional configuration identical to the shape of the retainer member 128 with opposed web portions 159 and 160 and respective standoff flanges 161. Each web portion 159, 160 has at least one standoff support 162 preferably centrally located on the web portion. This is conveniently molded on the web portions respectively on the outward face since inside corner junction member 110 is preferably injection molded. The standoffs 162 do not project beyond the inside facing surface of depending webs 146, 148 respectively and allow for the thickness of the inside corner cap member 114 when it is snapped into place, so that the edge 117 of web 116 for example will be slightly raised above the edge 119 of the web 146 of the depending cap portion 144. The same is true of the other web 118 of the inside corner cap member 114 so that a person looking up at the installed system will be less likely to observe the joint where the parts 114 and 144 are butted together. The retainer part is molded in place to form an integral part of the junction member 110 in same manner as the retainer parts 150 and 152.

Thanks to the provision of the integral molded vinyl plastic junction member 110 the requirement to make mitered joints between the members 46, 48 and 114 is eliminated and at least slight out of square or misalignment between these members can be easily accommodated by the flexibility of the junction member to compensate for misalignment or out of square of the adjacent walls 14 and 16 with respect to each other and with respect to the ceiling member 32. The flanges 105 of depending cap portion 144 and the opposed retainer portions 159, 160 of retainer part 158 all lie flush against the surface of the respective walls and so do the flanges 120, 122 of the inside corner cap member 114 when it is snapped into place on the retainer portion of the inside corner junction member.

Figure 5:
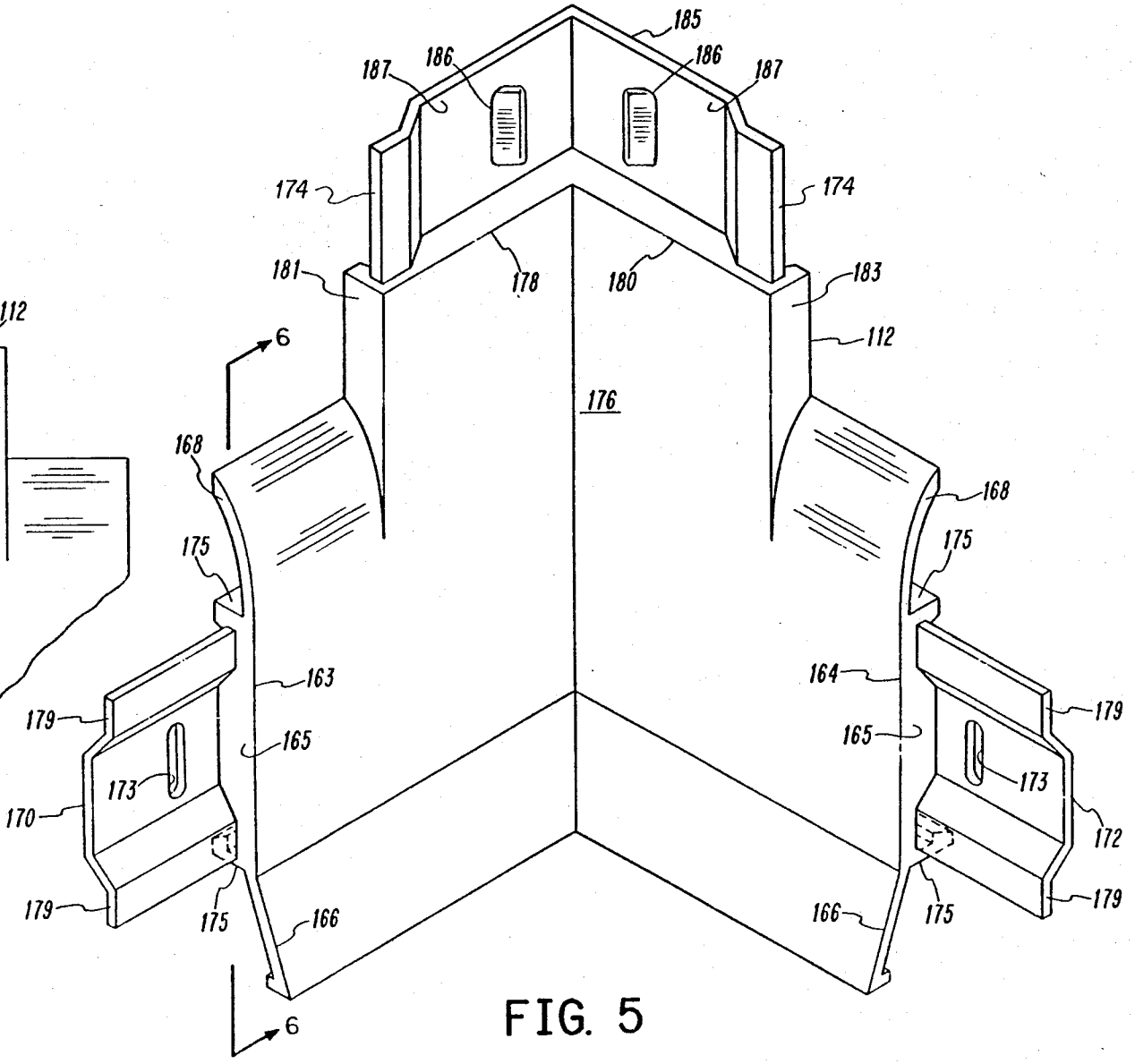
FIG. 5 is a perspective view of an inside corner base junction member for the junction of two baseboard members and an inside corner trim cap member.
Figure 6:
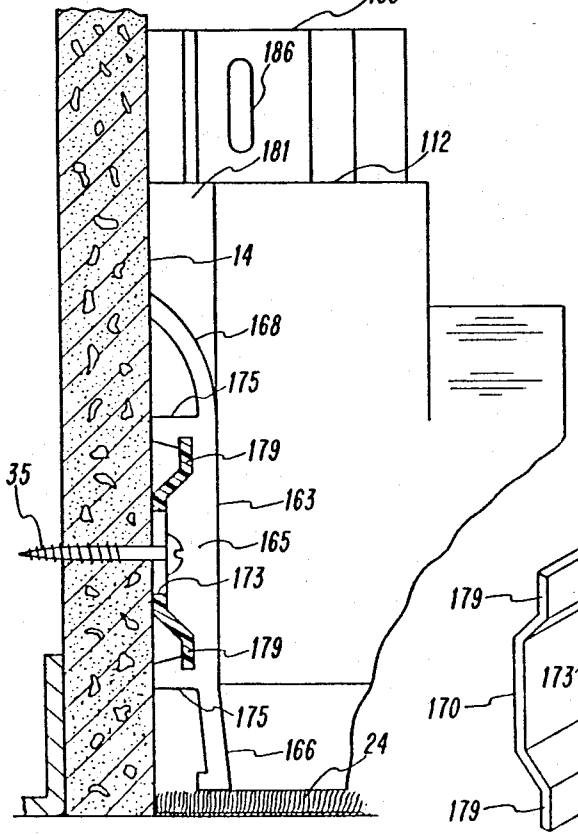
FIG. 6 is a section view taken along the line 6—6 of FIG. 5.
Figure 12:
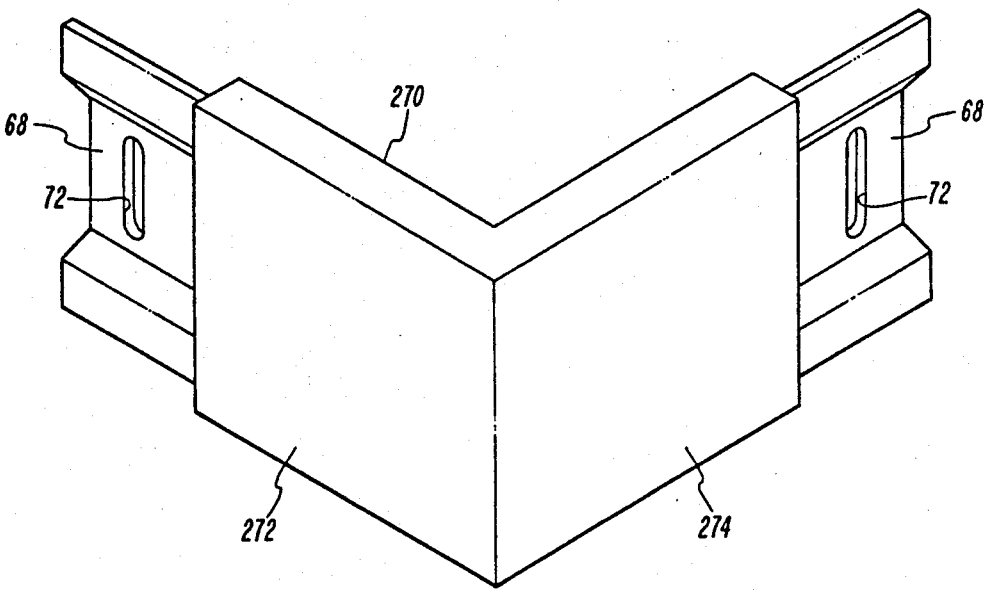
FIG. 12 is a perspective view of an outside corner junction member for joining two trim cap members.

Referring now to FIGS. 5 and 6, the inside corner baseboard junction member 112 comprises an integral, preferably molded vinyl plastic member having opposed baseboard portions 163 and 164 which are generally of the same cross sectional configuration as the baseboard trim member 80. In this regard the portions 163 and 164 each include a central, generally vertically extending web portion 165, a downwardly depending flange portion 166 and an arcuate upwardly extending flange protion 168. The baseboard junction member 112 also includes laterally projecting opposed retainer parts 170 and 172 having a cross sectional configuration identical with the retainer members 68 and including elongated slots 173 formed in each of the retainer parts for use in securing the junction member 112 to adjacent wall panels such as the panels 14 and 16. The retainer parts 170 and 172 are preferably molded integral with the member 112 or formed as separate parts and molded in assembly with the member 112 by using opposed projections 175, FIG. 6, to engage with opposed standoff flanges 179 formed on the retainer parts. The opposed projections held the baseboard junction member away from the wall especially if the junction member is made without the upstanding cap portion 176 so that the distal end of the arcuate portions and the projections 175 on both sides can lie flush with the corner walls. If the upstanding cap portion 176 is not included the shape of the baseboard portions is continued right into the corner where they meet. This is analogous to the modified cap junction member of FIG. 12.

The junction member 112 also includes an upstanding cap portion 176 having opposed webs 178 and 180 which extend at right angles and are integrally joined to each other. The webs 178 and 180 terminate at opposed flange portions 181 and 183 to form the cap portion 176 generally of the same cross sectional configuration as the inside corner cap member 114. A retainer part 185, having the same cross sectional shape as the retainer members 128, is molded integral or in assembly with the cap portion 187 and forms means for securing the lower end of the cap member 114 to the junction member 112. Retainer part 185 has opposed right angle webs 187 and opposed standoff flanges 174 adapted to receive and engage reentrant edges 123, 125 of inside corner cap member 114. Also molded on the outward facing surface of each of the opposed webs 187 of retainer portion 185 is at least one standoff support 186 which functions in the same way as does standoff supports 162 of the inside corner junction member 110.

With inside corner cap member 114 snapped in place over retainer part 185 of the baseboard junction member 112, the inside (visible) facing surfaces of inside corner member 114 are raised slightly above the level of the respective edges 178, 180 of cap portion 176 so that a person in the room looking down at the installed baseboard junction member with the inside corner cap in place would not as easily see the junction where the two are butted together at the top of cap portion 176 than he would if the surfaces of cap member 114 were sligtly below the surface of the cap portion 176.

The baseboard unit lies flush against the corner wall surfaces with at least the webs 170, 172, 187, the flanges 181, 183 and opposed projections 175 being in contact therewith. Some flexibility in the plastic allows the corner units to accommodate corners not exactly at 90°. Normally, for appearance sake arcuate flanges 168 are also in contact with wall surfaces.

In addition, the junction member 112 forms a one piece joint between the cap members 82, 84 and 114 to eliminate the requirement for the formation of mitered joints and to compensate for any minor gaps or misalignment between the walls 14 and 16 and the floor surface 24.

Referring again to FIG. 1, the intersection of the walls 16 and 20 also makes desirable the provision of an outside corner cap member 188 and trim junction members 189 and 190 to cover the joint between the adjacent walls. The junction members 189 and 190 are integral, one piece molded members which have the configuration of the cap members 48 and 50 and the baseboard trim members 84 and 86, respectively, to blend the configuration of these members into the configuration of the cap member 188. Moreover, the provision of the junction members 189 and 190 provides all of the advantages of the junction members 110 and 112 discussed previously herein.

Figure 8:
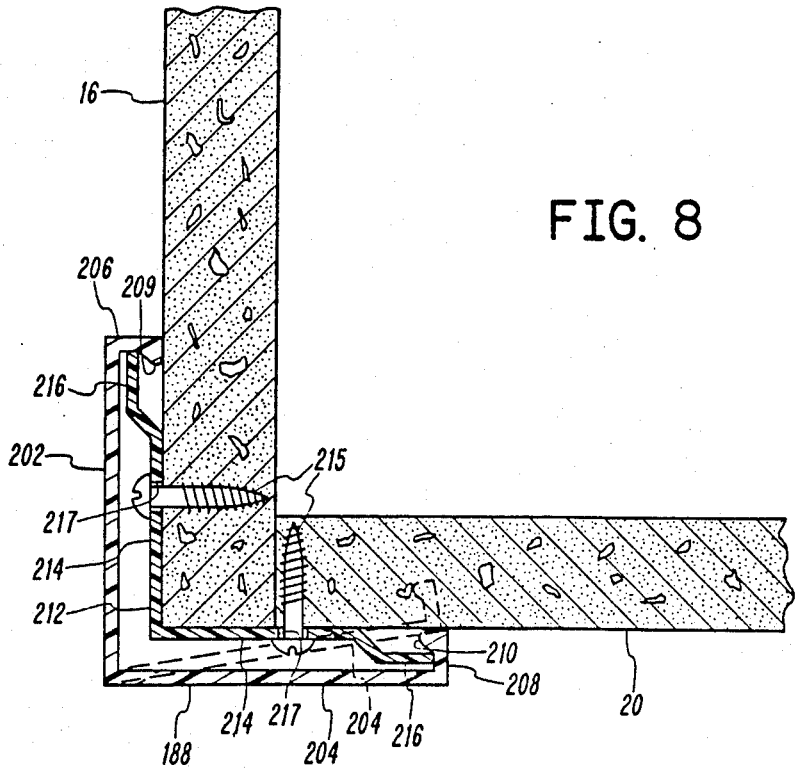
FIG. 8 is a detail section view taken along the line 8—8 of FIG. 7.
Figure 7:
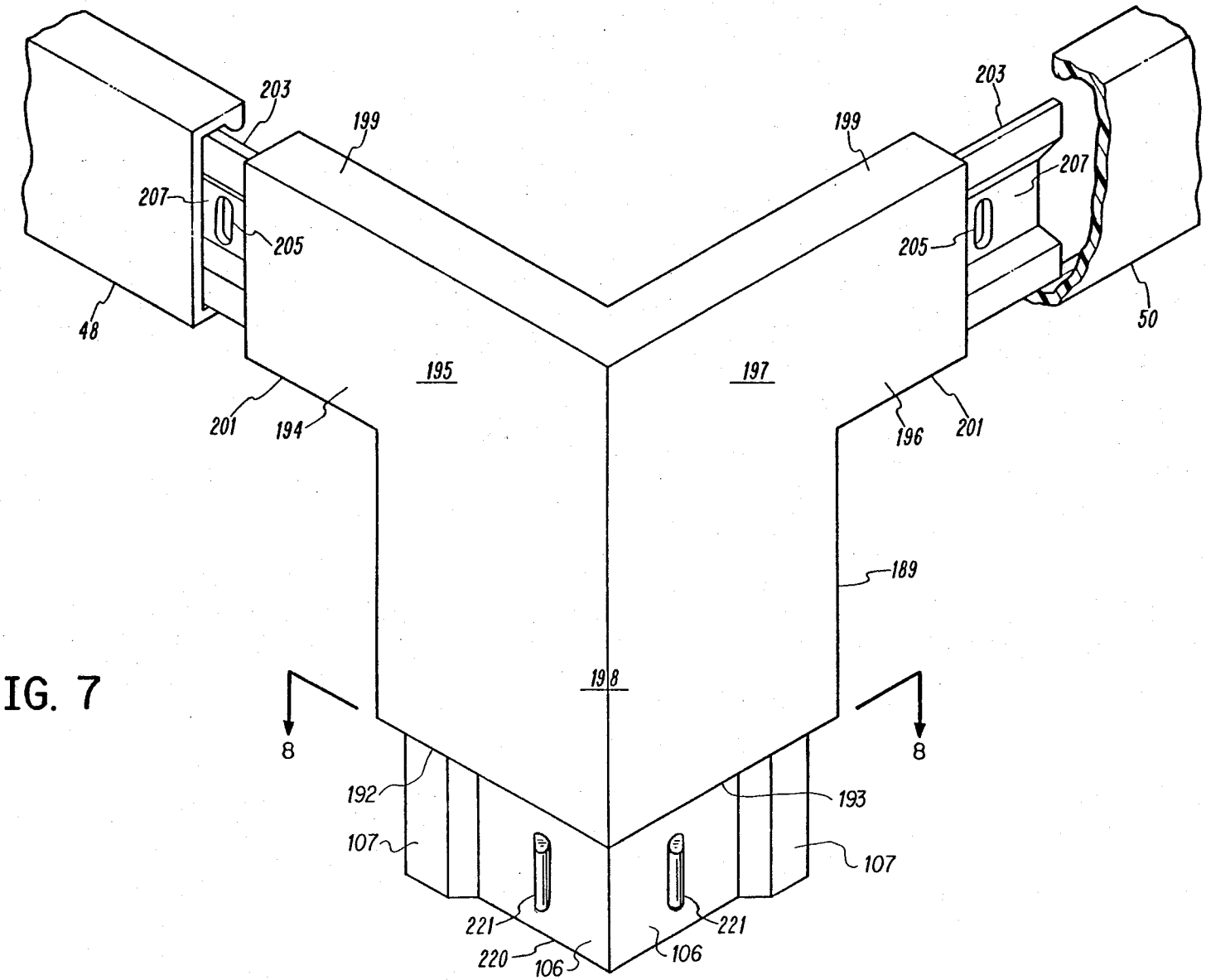
FIG. 7 is a perspective view of an outside corner junction member for the junction of two ceiling-wall trim cap members and the outside corner trim cap member.

Referring now to FIGS. 7 and 8, the junction member 189 includes opposed trim cap member portions 194 and 196 and a depending cap member portion 198. The cap member portions 194 and 196 have a cross sectional configuration similar to the trim cap members 48 and 50 and include planar web portions 195 and 197 each with opposed flanges 199 and 201. Retainer members 203 are molded in assembly with the member 189 and extend from the respective cap member portions 194 and 196 in directions perpendicular to each other and have the same cross sectional configuration as the retainer members 68, 150 and 152. Suitable elongated grooves 205 are provided in the web portions 207 of the retainer members to provide for securing the junction member 189 to the upper outside corner of the wall partition formed by the wall panels 16 and 20. Planar web portions 195, 197 extend into the depending cap member portion 198 culminating in edges 192, 193, respectively. Integrally molded retainer part 220 has opposed web portions 106 and opposed standoff flanges 107 shaped like the retainer of FIG. 8 and adapted to receive and hold a snapped on corner cap member 188. At least one standoff support 213 is located on each of the opposed standoff flanges 106. The standoffs 213 extend outwardly in a direction away from the flanges 106 but less than the distance to the planar surfaces of the edges 192, 193 by slightly more than the thickness of the cap member 188.

This is so that the joint between junction member 189 depending cap portion 198 and corner cap member 188 will not be visible when viewed from below because the edge of the cap member at the butted joint is slightly above the edges 192, 193. There is no visible edge for the eye to pick up and this makes for a much improved appearance. Only a slight difference is desirable of course and this way may take some care in the selection of manufacturing tolerances on the respective parts.

Referring to FIG. 8, the cap member 188 is characterized by webs 202 and 204 extending perpendicular to each other and integrally joined to each other. The webs 202 and 204 include respective distal flange portions 206 and 208 which are each provided with reentrant edges 209 and 210 similar to the configuration of the reentrant edges of the inside corner trim cap member 114. Outside corner retainer plate members 212 are provided having opposed web portions 214 and opposed standoff flanges 216 cooperable with the reentrant edges 209 and 210 of the cap member 188 to secure the cap member in its mounted position shown in FIG. 8. The retainer member 212, shown in FIG. 8, is secured to the walls 16 and 20 by fasteners 215, similar to the fasteners 35, and which extend through vertically extending slots 217 in the web portions 214. The cap member 188 is also preferably formed of extruded or molded vinyl plastic according to the above referenced specification and the web portions 202 and 204 are molded in a relaxed condition wherein the angle formed between the web portions is less than 90° as indicated by the dashed line position of the web portion 204 in FIG. 8. In this way the cap member 188 can be mounted on the retainer members 212 and snapped over the standoff flanges 210 with the elastic memory of the web portions sufficient to aid in retaining the cap member 188 in position covering the corner joint between the wall panels 16 and 20.

Referring again to FIG. 7, it will be noted that the junction member 189 also includes a retainer part 220 depending from the cap part 198 and having the same cross sectional configuration as the retainer member 212. The depending cap part 198 has a cross sectional shape or configuration similar to the cap member 188 and is integrally molded with or around the retainer part 220. Accordingly, the trim cap members 48, 50 and 188 may be easily joined without the requirement of cutting mitered or closely fitted joints and may be secured to the junction member 189 by the respective retainer parts 203 and 220.

Figure 9:
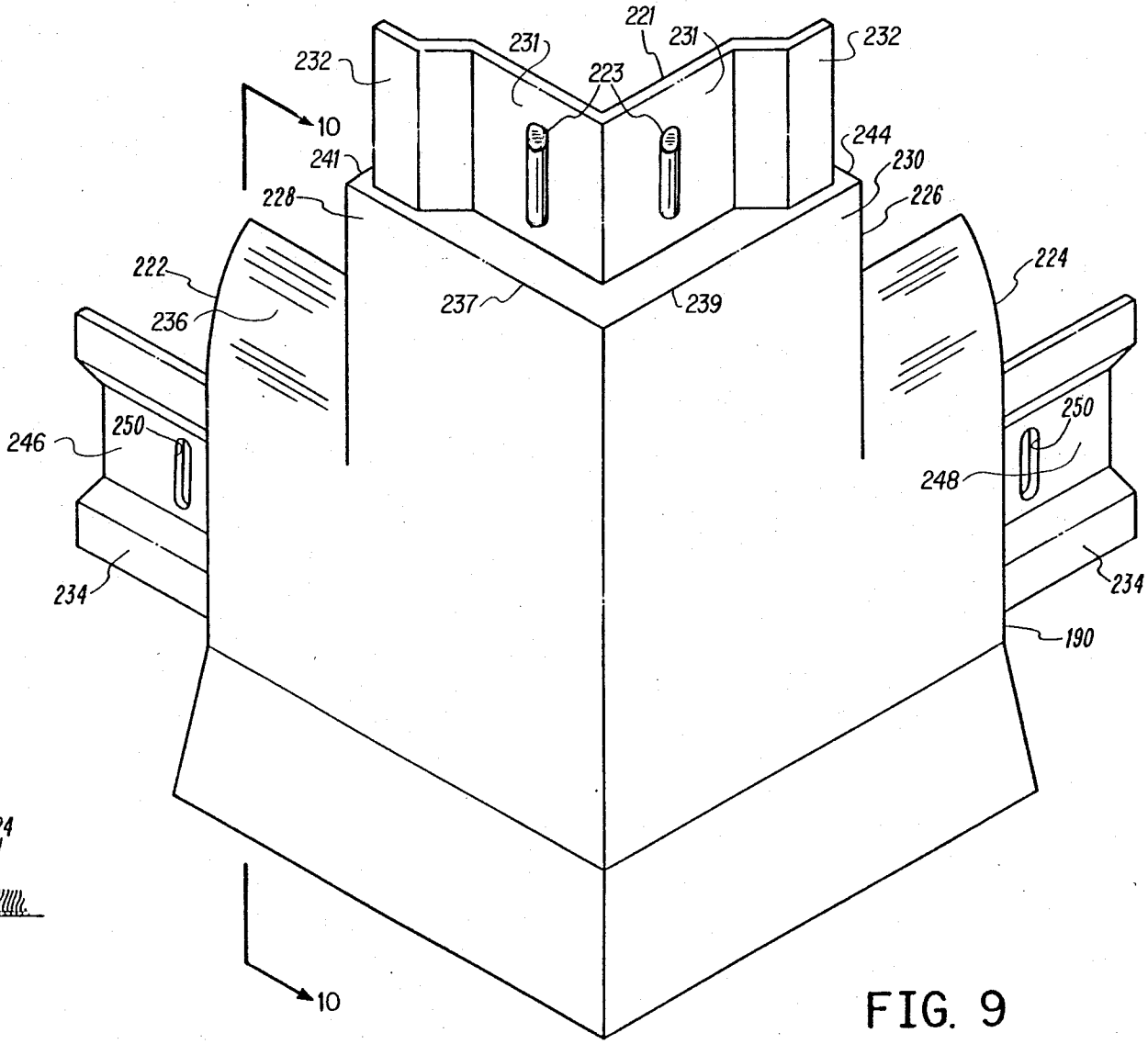
FIG. 9 is a perspective view of an outside corner base junction member for two baseboard members and an outside corner trim cap member.
Figure 10:
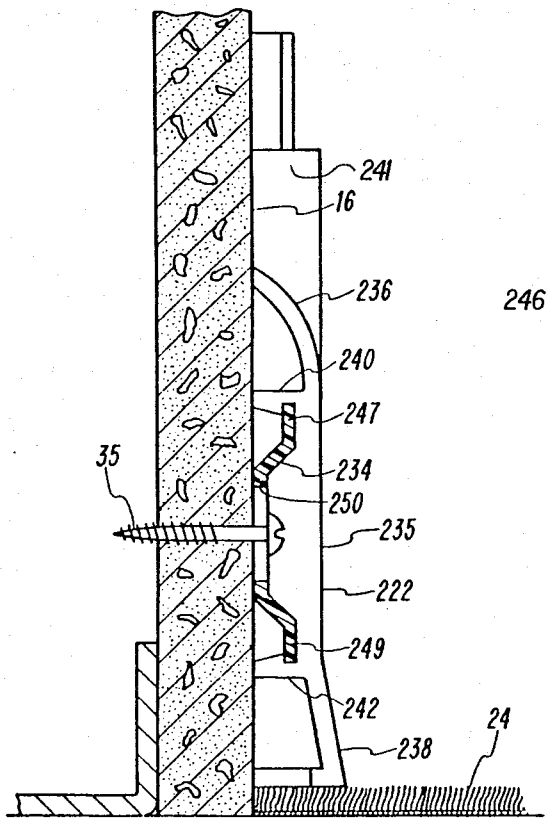
FIG. 10 is a detail section view taken along the line 10—10 of FIG. 9.

Referring now to FIGS. 9 and 10 the baseboard junction member 190 is characterized by opposed baseboard cap member portions 222 and 224 which are integrally joined to each other, extend at right angles and have a cross sectional configuration, as shown by way of example in FIG. 10, similar to the configuration of the baseboard members 84 and 86. The junction member 190 also includes an integral upstanding outside corner cap member portion 226 formed as an integral part of the member 190 and having opposed web portions 228 and 230 having flanges respectively 241, 244, which may be molded in assembly or integral with a retainer part 221.

Retainer part 221 is similar in all respects to retainer part 220 of trim junction member 189 in FIG. 7. It has opposed web portions 231 joined at right angles to each other and includes opposed standoff flanges 232 like the retainer of FIG. 8. Mounted on each of the opposed web portions 231 is at least one standoff support 223. The standoff supports extend toward the surface of the cap member portion 226 of base board junction 190 but below the edges 237, 239 of opposed corner cap member web portions 228, 230 by slightly less than the thickness of the snap—on outside corner cap member 188 so that the cap member will be slightly above the edges 237, 239 when it is installed. Thus as was the case with respect to the junction member 189, the observer in the room won't be able to see the butted joint at the edges 237, 239.

Retainer parts 234 are also molded in assembly or integral with the opposed cap member portions 222 and 224, respectively, and have the configuration of the other retainer parts used for the baseboard members 82, 84, 86 and 88. As shown in FIG. 10, by way of exmple, the baseboard cap member portion 222 includes a central web portion 235, an upper arcuate flange 236 and a depending flange 238 terminating adjacent the floor 24. The central web portion includes molded spaced apart flanges 240, 242 which together with the webs 246, 248 of retainer parts 234 and the flanges 241, 244 lie flush against the respective wall surfaces of an outside corner when the baseboard trim member 190 is installed. The arcuate upper portion of flange 236 will then also abut the wall surface.

The retainer parts 234 are preferably integrally molded as part of the junction member 190. Suitable fasteners 35 extend through vertically extending slots 250 formed in the retainer part 234. To secure the junction member 190 to a wall panel the arcuate flange portions 222 and 224 are flexible enough to provide for slight deflection at the distal edges of the flange portions so that they match the arcuate flange portions 92 of the baseboard member 80 and counterpart portions thereof.

Figure 11:
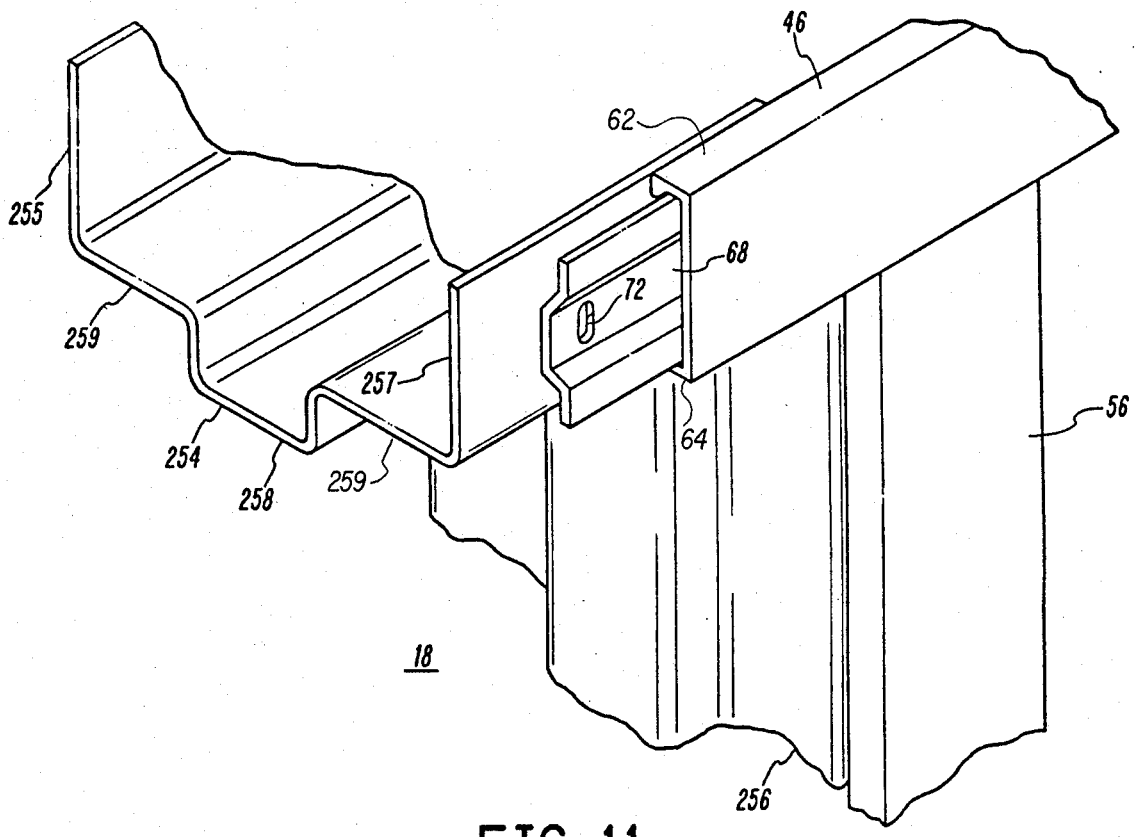
FIG. 11 is a detail perspective view of a joint between two trim cap members at a door or window frame.

Referring to FIG. 11, there is illustrated a portion of the frame for the doorway 18 which may comprise elongated extruded channel shaped members 254 and 256. As shown by way of example, the channel shaped member 254 includes opposed flange portions 255 and 257 and an integral secondary channel portion 258 forming a doorjamb extending from a web portion 259. The configuration of the member 256 may be virtually identical to that of the member 254 and both members may be formed of extruded vinyl plastic according to the specification referenced herein. The entire doorway 18 may be framed by members 254 and 256 and the trim members 46 and 56 may be secured to the respective flange portions of the frame members. The frame members 254 and 256 are suitably dimensioned with respect to their opposed flange portions such as the flange portions 255 and 257 so as to slip over conventional subframing for the doorway 18.

In certain applications of the trim or molding system described herein the cap members such as the members 46, 48 or 50 and the baseboard members 82, 84 and 86 may be joined at intersections of adjacent walls wherein a corner cap member such as a member 114 or 188 is not required. In such instances junction members such as the junction member 270, FIG. 12, may be provided and have the same cross sectional configuration as the cap members 46 or 48, for example. The member 270 has opposed web portions 272 and 274 extending at right angles to each other and integrally joined to each other. The web portions 272 and 274 are interposed between respective flanges having the configuration of the flanges 62 and 64, for example, of the cap member 46 and adapted to be secured to or molded in assembly with respective retainer parts 68. Those skilled in the art will recognize that inside and outside corner junction members for the baseboard members 84 and 86 may be provided without the vertical upstanding integral corner cap portions when such portions are not required. Normally, a joint between cap members 46 and 48, for example, may be made at an inside corner junction without a premolded junction member if an inside corner cap member is not used.

The installation of the trim system of the present invention is believed to be readily understandable from the foregoing descripiton of the various components including the cap members and the junction members. As the junction members 110, 112, 189 and 190 are preferably molded with their respective retainer members formed integral therewith these parts are ready for installation for any right angle wall intersection of either an outside or inside corner, respectively. Only the cap members 46, 48, 50 and 52 and the baseboard members 80, 82, 84, 86 and 88 are required to be cut to length as well as the inside and outside corner cap members 114 and 188. The junction members 110, 112, 189 and 190 can be installed first followed by determining the length of the cap members and cutting these cap members as required. The retainer members 68 for both the wall-to-ceiling trim cap members and the wall-to-floor baseboard members may be installed at predetermined spaced apart intervals and the cap members and baseboard members then snapped over the standoff flanges as described above and also snapped over the standoff flanges of the retainer portions of the respective junction members. Thanks to the flexibility of the cap members and baseboard members they compensate for any irregularities in the plane of the wall surfaces or misalignment of the junction members. Moreover, the provision of the slotted retainer members and retainer parts 68, 150, 152, 170, 172, 207 and 234, for example, permits adjustment of the various trim members after application to the wall panels thanks to the elongated slots formed in the web portions of the respective retainer members. Alignment of the retainer members 68 with each other on a wall panel may be obtained by using an elongated piece of baseboard member 80, for example, which has been cut away above the projection 102 so that access to the retainer members may be provided for inserting fasteners 35.

In the installation of the cap members and baseboard member 46 and 80, respectively, for example, and the installation of the various inside and outside corner trim members described herein a typical and preferred procedure would be to install the retainer members 68 at predetermined intervals approximately 2.0 feet along the edges of a wall panel to be installed and secured to the support headers 30 and 34, for example, but prior to such installation, thus eliminating the need to install the retainer members at a later time. The various ceiling to wall and floor to wall trim members and the corner trim members may be installed after painting or tapeing and bedding of the wall panelings forming the respective partitions. Accordingly, this increases the speed with which painting and wall finishing operations may be conducted since it is not necessary that painters or plasterers take the care to avoid damaging or disfiguring the trim system as is necessary with prior art type molding or trim systems. Polyethylene is the preferred material for the retainer members, such as retainer 68 because paint and plaster is easily wiped or brushed off because it does not stick to polyethylene even when dried.

All of the trim members can be installed after the wall panels are completely finished and the retainer members adjusted to close any gaps in the joints between the various wall panels, the ceiling panels and the floor structure.

The advantages provided by the present invention in regard to the ease of installation to provide a finished system which is aesthetically appealing and does not require highly skilled labor also reduces the burden on the building contractor or owner since the purchase or specification of a trim system in accordance with the present invention assures the contractor that an easy to install and aesthetically appealing system will be provided. By locating joints between adjacent trim members and corner cap members away from corner intersections and by eliminating the need to make mitered joints the overall appearance of the trim system is enhanced as it is only necessary to cut the trim cap members and baseboard members to form edges perpendicular to the longitudinal extent of these members, this being the only cutting or modifying operation required in the field.

The utilization of a sytem in accordance with the present invention enables the building developer or contractor to more accurately determine labor costs associated with installing the trim system. The risk of having a poorly installed system is reduced and the overall quality of the prefabricated corner cap members is assured. Since the junction members are injection molded and the cap members and retainer members are extruded, both high volumn production processes, the parts for the trim system are low cost as well.

Although a preferred embodiment of an interior wall trim system and components thereof has been described in detail herein, those skilled in the art will recognize that various substitutions and modifications may be made to the specific structural features of the components and the overall system without departing from the scope and spirit of the invention as recited in the appended claims.

What I claim is:

1. In a room partition wall trim cap assembly for trimming the junction between wall panels and ceiling, the combination of spaced apart cap trim retainer members, with vertical adjustment means; corner cap junction members having cap portions extending at right angles to each other and including retainer part means on each cap portion, extending beyond said cap portions; and elongated trim cap members having a planar web and opposed flanges engageable and disengageable with one or more of said retainer members and one of said retainer part means when said corner cap junction members and said retainer members are mounted on a wall adjacent a ceiling.

2. The assembly of claim 1 wherein the retainer members have a flat web portion with opposed standoff flanges, said web portion being adapted for contact with a wall surface when installed, with the standoff flanges away from said surface; the corner cap junction member cap portions which are at right angles to each other extend laterally from a corner, each having a retainer part with the cross section of the retainer members and a web portion adapted for contact with the wall surface with opposed standoff flanges away from the wall surface, the cap portions also having integral flanges adapted to hold the surface of the cap portions out away from the wall surface but with the web portion of the retainer part remaining in contact with the wall surface when the retainer part is fastened to the wall; said cap trim members having inward facing reentrant edge portions on the opposed flanges which snap onto or off of the standoff flanges of the retainer members and a retainer part of the corner cap junction member, with the planar web of the cap trim member even with the surface of the cap portion of the junction member to neatly trim the wall to ceiling junction through a corner.

3. In a baseboard wall trim assembly for trimming the juncture between vertical partition walls and a floor, the combination of spaced apart baseboard retainer members; at least one baseboard junction member; and an elongated baseboard trim member all to be mounted on a wall adjacent a floor; said retainer members having a wall contacting web portion with opposed standoff flanges and means for vertical adjustment; said baseboard trim member includes a generally planar web portion with a generally arcuate upper flange portion terminating at a distal end, and a lower generally planar flange portion opposite said arcuate portion, and including spaced apart projections with opposed reentrant edges adapted to snap on and off said retainer members; said baseboard junction member having opposed baseboard portions extending at right angles to each other and having generally the same cross sectional shape as the baseboard trim member and including retainer part means on each baseboard portion extending beyond said baseboard portion; said baseboard trim member projections being engageable and disengageable with standoff flanges of one or more of said retainer members and one of said retainer part means when said baseboard junction member and said retainer members are mounted on a wall adjacent a floor.

4. The assembly of claim 3 wherein the retainer members have a flat web portion with opposed standoff flanges, said web portion being adapted for mounting on a wall surface with standoff flanges away from said surface; the baseboard portions of said baseboard junction member which are at right angles to each other, extend laterally from a corner, the extending retainer part having the cross section of the retainer members, the web portion thereof adapted for contact with the wall surface with opposed standoff flanges away from the wall surface, the baseboard portion also having opposed projections adapted to hold the baseboard portion the same distance out away from the wall surface as the baseboard trim members so that they can butt smoothly against each other when installed, said web portion being in contact with the wall surface also and serving as a place to fasten the baseboard junction member to the wall; said baseboard trim members being flush with the baseboard portions of said baseboard and covering the retainer portion thereof when the assembly is installed to neatly trim the wall to floor junction through a corner.

5. The baseboard wall trim assembly of claim 3 further providing compatible trim for a vertical wall corner, the combination further including an upstanding cap portion of said baseboard junction member having an upper edge, said member having opposed integral web portions at right angles to each other terminating at opposed flange portions extending above the arcuate upper flange of the baseboard portion, generally coextensive with the distal end thereof; said cap portion includes a second retainer part means extending upwardly beyond said upstanding cap portion, having opposed right angle web portions adapted to fit a wall corner, each having a standoff flange; an elongated retainer plate having right angle planar webs adapted to fit said wall corner and having standoff flanges, said retainer plate and said second retainer part having the same cross section; and an elongate corner cap member having right angle planar webs with opposed flanges adapted to snap on or off the standoff flanges of the retainer plate and the second retainer means and to cover them when installed at a wall corner adjacently and mounted thereto, to trim said vertical wall corner as well as the wall to floor junction.

6. The assembly of claim 5 wherein each web of the second retainer part means of the upstanding cap portion of the baseboard junction member has a standoff support sized to prevent the corresponding web of the corner cap member from going below the level of the upper edge of the upstanding cap portion when the corner cap member is snapped into place over the second retainer part adjacent to and abutting the edge of the upstanding cap portion, so that the joint between them is less visible from above.

7. The baseboard wall trim assembly of claim 4 further providing compatible trim for a vertical wall corner, the combination further including an upstanding cap portion of said baseboard junction member having an upper edge, having opposed integral web portions at right angles to each other terminating at opposed flange portions extending above the arcuate upper flange of the baseboard portion, generally coextensive with the distal end thereof; said cap portion includes a second retainer part means extending upwardly beyond said upstanding cap portion, having opposed right angle web portions adapted to fit a wall corner, each having a standoff flange; and elongated retainer plate having right angle planar webs adapted to fit said wall corner and having standoff flanges, said retainer plate and said second retainer part having the same cross section; and an elongate corner cap member having right angle planar webs with opposed flanges adapted to snap on or off the retainer plate and the second retainer means and to cover them when installed at a wall corner and mounted thereto, to trim said vertical wall corner as well as the wall to floor junction.

8. The assembly of claim 7 wherein each web of the second retainer part means of the upstanding cap portion of the baseboard junction member has a standoff support sized to prevent the corresponding web of the corner cap member from going below the level of the upper edge of the upstanding cap portion when the corner cap member is snapped into place over the second retainer part adjacent to and abutting the edge of the upstanding cap portion, so that the joint between them is less visible from above.

9. In a room partition wall trim cap assembly for trimming the junction between wall panel and ceiling, including trim for a vertical wall corner, the combination of spaced apart retainer members; corner cap junction members having laterally extending cap portions extending at right angles to each other and including first retainer part means on each cap portion extending beyond said cap portions; elongated trim cap members having a planar web and opposed flanges engageable and disengageable with one or more retainer members and one of said first retainer part means to trim a wall to ceiling joint; said corner cap junction member also including an integral vertically depending corner cap portion extending normal to said cap portions of said corner cap member, having a similar cross section and a lower edge, and including a second retainer part means extending beyond said depending cap portion, said second retainer part having opposed right angle web portions adapted to fit a wall corner, each having a standoff flange; an elongated retainer plate having right angle planar webs adapted to fit said wall corner and having standoff flanges, said second retainer part and said retainer plate having the same cross section; and an elongate corner cap member having right angle planar webs with opposed flanges adapted to snap on or off the standoff flanges of the retainer plate and the second retainer part means and to cover them, when the corner cap junction member and retainer plate are assembled adjacently at said wall corner and mounted thereto, to trim said vertical wall corner.

10. The assembly of claim 9 wherein each web of the second retainer part means of the depending cap portion of the corner cap junction member has a standoff support which serves to prevent the corresponding web of the corner cap member from going below the edge of the depending cap portion when the corner cap member is placed over the second retainer part and snapped into place adjacent to an abutting the edge of the depending cap portion, so that the joint between them is less visible from below.

11. In a room partition wall trim assembly for trimming the junction between wall panels and ceiling, and the junction between wall panels and floor, the combination of spaced apart cap trim retainer members, with vertical adjustment means; corner cap junction members having cap portions extending at right angles to each other and including retainer part means on each cap portion extending beyond said cap portions; and elongated trim cap members having a planar web and opposed flanges engageable and disengageable with one or more of said retainer members and one of said retainer part means when said corner cap junction members and said retainer members are mounted on a wall adjacent a ceiling; spaced apart baseboard retainer members; at least one baseboard junction member; and an elongated baseboard trim member, all to be mounted on a wall adjacent a floor; said retainer members having a wall contacting web portion with opposed standoff flanges and means for vertical adjustment; said baseboard trim member includes a generally planar web portion with a genrally arcuate upper flange portion terminating at a distal end, and a lower generally planar flange portion opposite said arcuate portion, and including spaced apart projections with opposed reentrant edges adapted to snap on and off said baseboard retainer members; said baseboard junction member having opposed baseboard portions extending at right angles to each other and having generally the same cross sectional shape as the baseboard trim member and including retainer part means on each baseboard portion extending beyond said baseboard portion; said baseboard trim member projections being engageable and disengageable with standoff flanges of one or more of said baseboard retainer members and one of said retainer part means when said baseboard junction member and said baseboard retainer members are mounted on a wall adjacent a floor.

12. The assembly of claim 11 further providing compatible trim for a vertical wall corner wherein the trim runs vertically to the corner cap junction member at the ceiling and to the baseboard junction member at the floor, the combination further including an upstanding cap portion of said baseboard junction member having an upper edge, said member having opposed integral web portions at right angles to each other terminating at opposed flange portions extending above the arcuate upper flange of the baseboard portion, generally coextensive with the distal end thereof; said cap portion includes a second retainer part means extending upwardly beyond said upstanding cap portion, having opposed right angle web portions adapted to fit a wall corner, each having a standoff flange; said corner cap junction member also including an integral vertically depending corner cap portion extending normal to said cap portions of said corner cap member, having a similar cross section and a lower edge, and including a third retainer part means extending beyond said depending cap portion, said third retainer part having opposed right angle web portions adapted to fit a wall corner, each having a standoff flange; an elongated retainer plate having right angle planar webs adapted to fit said wall corner and having standoff flanges, said third retainer part of said depending corner cap portion, said second retainer part of said upstanding cap portion of said baseboard junction member, and said retainer plate having the same cross section; and an elongate corner cap member having right angle planar webs with opposed flanges adapted to snap on or off the standoff flanges of the retainer plate and of the said retainer part means of said corner cap junction member and said baseboard junction member and to cover said retainer part means when the corner cap junction member, baseboard junction member and retainer plate are assembled adjacently at a wall corner and mounted thereto, to trim said vertical wall corner from floor to ceiling.

13. The assembly of claim 12 wherein the trim cap members, corner cap members retainer plate, and retainer members are formed of extruded polyethylene and the corner cap junction member and baseboard junction member are formed of injection molded plastic.

* * * * *